US007184674B2

(12) United States Patent
Satoh et al.

(10) Patent No.: US 7,184,674 B2
(45) Date of Patent: Feb. 27, 2007

(54) DETECTING DEVICE FOR AN IMAGE FORMING APPARATUS

(75) Inventors: Osamu Satoh, Kanagawa (JP); Katsuaki Miyawaki, Kanagawa (JP); Masaaki Yamada, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 295 days.

(21) Appl. No.: 10/942,899

(22) Filed: Sep. 17, 2004

(65) Prior Publication Data

US 2005/0100374 A1 May 12, 2005

(30) Foreign Application Priority Data

Sep. 17, 2003 (JP) ..... 2003-324354
Jul. 20, 2004 (JP) ..... 2004-211402

(51) Int. Cl.
*G03G 21/00* (2006.01)

(52) U.S. Cl. ..... 399/34; 399/350
(58) Field of Classification Search ..... 399/34, 399/350, 351
See application file for complete search history.

(56) References Cited

U.S. PATENT DOCUMENTS 4,937,633 A * 6/1990 Ewing ..... 399/350
5,278,620 A * 1/1994 Godlove ..... 399/351
5,300,952 A 4/1994 Wada et al.
5,371,522 A 12/1994 Miyawaki et al.
5,379,058 A 1/1995 Obu et al.
5,612,278 A 3/1997 Masubuchi et al.
5,708,938 A 1/1998 Takeuchi et al.
5,721,085 A * 2/1998 Oshiba et al. ..... 399/350
5,848,329 A 12/1998 Aoyama et al.
5,968,301 A 10/1999 Murakami et al.
6,108,508 A 8/2000 Takeuchi et al.
6,203,962 B1 * 3/2001 Itami et al. ..... 399/350
6,324,374 B1 11/2001 Sasamoto et al.
6,515,747 B1 2/2003 Satoh et al.

(Continued)

FOREIGN PATENT DOCUMENTS

JP 5-273893 10/1993

(Continued)

OTHER PUBLICATIONS

U.S. Appl. No. 11/370,057, filed Mar. 8 2006, Yamada et al.

(Continued)

*Primary Examiner*—William J. Royer
(74) *Attorney, Agent, or Firm*—Oblon, Spivak, McClelland, Maier & Neustadt, P.C.

(57) ABSTRACT

The present invention provides a detector that brings a cleaning blade made from elastomer in contact with a photoconductor to observe vibrations of the cleaning blade or a supporting member for the cleaning blade and calculates an index value based upon a normal condition using multi-dimensional data for each frequency obtained by Fourier transform of the vibrations as signals, thereby detecting abnormality of a condition of contact of the cleaning blade with the photoconductor such as the presence of adhesion material or damage to the photoconductor.

30 Claims, 15 Drawing Sheets

U.S. PATENT DOCUMENTS

| | | | |
|---|---|---|---|
| 6,556,802 | B2 | 4/2003 | Sasamoto et al. |
| 6,560,438 | B2 | 5/2003 | Kosuge |
| 6,628,908 | B2 | 9/2003 | Matsumoto et al. |
| 6,628,915 | B2 | 9/2003 | Muramatsu et al. |
| 6,644,236 | B2 | 11/2003 | Sahashi |
| 6,694,112 | B2 | 2/2004 | Sasaki et al. |
| 6,707,480 | B2 | 3/2004 | Ameyama et al. |
| 6,757,512 | B2 | 6/2004 | Miyawaki et al. |
| 6,768,879 | B2 | 7/2004 | Kosuge |
| 6,768,891 | B2 | 7/2004 | Sasamoto et al. |
| 6,785,490 | B2 | 8/2004 | Tsukamoto et al. |

FOREIGN PATENT DOCUMENTS

| | | |
|---|---|---|
| JP | 6-95555 | 4/1994 |
| JP | 8-129327 | 5/1996 |
| JP | 2003-5597 | 1/2003 |

OTHER PUBLICATIONS

U.S. Appl. No. 11/452,411, filed Jun. 14, 2006, Shoji et al.

* cited by examiner

DETECTING DEVICE FOR AN IMAGE FORMING APPARATUS

CROSS-REFERENCE TO RELATED APPLICATIONS

The present document incorporates by reference the entire contents of Japanese priority document, 2003-324354 filed in Japan on Sep. 17, 2003 and 2004-211402 filed in Japan on Jul. 20, 2004.

BACKGROUND OF THE INVENTION

1) Field of the Invention

The present invention relates to a technology for detecting filming of toner or additive occurring on an image carrier (a photoconductor, an intermediate transfer member, or the like) of an image forming apparatus of an electrostatic photographing type.

2) Description of the Related Art

In the field of image forming apparatuses of electrostatic photographing type, fixing of toner component to image carriers, such as photoconductors or intermediate transfer members, is called "filming". Such filming lowers the quality of the image forming apparatus with time or reduces life of the image carrier. Various methods have been proposed to solve this problem. However, to solve this problem it is necessary to accurately detect presence of filming on the image carrier, because, accurate determination leads to reduction in operation time and less damage to the image carrier.

There are mainly two methods for detecting filming on a photoconductor. A first method includes detecting change of an amount of light reflecting from the surface of the photoconductor. A second method includes monitoring how a cleaning blade comes in contact with the photoconductor. The second method includes detecting an amount of bending of the cleaning blade, detecting an amount of displacement of a supporting shaft of the cleaning blade, and the like.

Japanese Patent Application Laid-open No. H5-273893 discloses a conventional image forming apparatus. This image forming apparatus has a light emitting element that irradiates light onto a surface of an image carrier, a first light receiving element that receives light that is regularly reflected from the surface of the image carrier, a second light receiving element that receives light that is irregularly reflected from the surface of the image carrier. A comparing unit compares the amount of light detected by the first and second light receiving elements with a reference value. A control unit controls operation of a rubbing member based on the result obtained by the comparing unit.

Japanese Patent Application Laid-open No. H6-95555 discloses another conventional image forming apparatus. This image forming apparatus includes an image carrier and a cleaning blade which abuts on the image carrier to remove residual toner. Moreover, a filming removing member that removes filming on the image carrier by coming in contact with the image carrier. A rotational angle detecting member detects a rotational angle of a rotating shaft of the cleaning blade. A filming detector detects presence of filming based on the result of detection by the rotational angle detecting member.

Japanese Patent Application Laid-open No. H8-129327 discloses still another image forming apparatus. This image forming apparatus includes a strain gauge that detects an amount of strain on a cleaning blade. An amplifier amplifies a signal output from the strain gauge to a predetermined level. The strain on the cleaning blade varies depending on friction with a photosensitive drum. Presence of filming is determined based on the output of the strain gauge.

Japanese Patent Application Laid-open No. H2003-5597 discloses another conventional image forming apparatus. This image forming apparatus includes a recording member carrier that carries and conveys a recording member, an image forming unit that forms a toner image on a recording member carried by the recording member carrier, a unit that transfers the toner image on a transfer member, and a cleaning unit that cleans the recording member carrier, where a cleaning blade itself or a clamping metal plate for the cleaning blade is mounted with a magnetic member for controlling a strain amount of the cleaning blade in a fixed range and the cleaning blade is attracted and corrected by a magnetic force of a solenoid coil provided. The cleaning blade can be directly pulled by a chuck and corrects the same.

The conventional image forming apparatuses have a problem that the parameter they measure, for detecting presence of filming, change minutely with presence of filming so that, sometimes, although there is filming, it can not be detected.

Filming does not always occur evenly on a photoconductor surface. Therefore, particularly, in detecting strain on the cleaning blade, many strain gauges must be arranged in order to achieve an even sensitivity over the whole area on which the cleaning blade abuts.

In detection of an amount of reflected light, there is also a problem that fluctuation of sensitivity due to a wavelength in such an apparatus as a color image forming apparatus becomes large, which results in a configuration too complicated to observe the whole surface of a photoconductor.

SUMMARY OF THE INVENTION

It is an object of the present invention to solve at least the problems in the conventional technology.

A detector according to an aspect of the present invention detects abnormality regarding a condition of contact of a blade, wherein a blade made from elastomer is brought into contact with a rotating member, vibrations of the blade or a supporting member for the blade is observed, an index value based upon a normal condition is calculated by multi-dimensional data for each frequency obtained according to Fourier transform of the vibrations as signals, so that abnormality regarding a condition of contact of the blade such as presence of adhesion material or damage to the rotating member is detected.

A cleaning device according to another aspect of the present invention is disposed so as to be opposed to an image carrier which carries an electrostatic latent image and forms a toner image developed with developer, and which is provided with a cleaning blade which cleans at least toner on the image carrier and a supporting member which supports the cleaning blade. A detecting device includes a detector that observes vibrations of a cleaning blade coming into contact with an image carrier or a blade supporting member which supports the cleaning blade to calculate an index value based upon a normal condition using multi-dimensional data for each frequency obtained according to Fourier transform of the vibrations as signals, thereby detecting abnormality of a condition of contact of the cleaning blade with the image carrier such as presence of adhesion material or damage to the image carrier.

A process cartridge according to still another aspect of the present invention supports an image carrier and at least one of a charging device, a developing device, and a cleaning device integrally, and is attachable to/detachable from an image forming apparatus main unit. The process cartridge includes a detector that observes vibrations of a cleaning blade coming into contact with an image carrier or a supporting member which supports the cleaning blade to calculate an index value based upon a normal condition using multi-dimensional data for each frequency obtained according to Fourier transform of the vibrations as signals, thereby detecting abnormality of a condition of contact of the cleaning blade with the image carrier such as presence of adhesion material or damage to the image carrier.

A process cartridge according to still another aspect of the present invention supports at least a cleaning device and an image carrier integrally and is attachable to/detachable from an image forming apparatus main unit, wherein the process cartridge disposes a cleaning device. The cleaning device includes a detector that observes vibrations of a cleaning blade coming into contact with an image carrier or of a supporting member which supports the cleaning blade to calculate an index value based upon a normal condition using multi-dimensional data for each frequency obtained according to Fourier transform of the vibrations as signals, thereby detecting abnormality of a condition of contact of the cleaning blade with the image carrier such as presence of adhesion material or damage to the image carrier.

An image forming apparatus according to still another aspect of the present invention includes an image carrier on which an electrostatic latent image is formed, a charging device that brings a charging member in contact with a surface of the image carrier or causes the charging member to contact on the surface of the image carrier for charging the image carrier, a latent image forming device that forms a latent image on the image carrier, a developing device that causes toner to adhere to the latent image on the image carrier to develop the same, a transfer device that forms a transfer electric field between the image carrier and a surface moving member while coming into contact with the image carrier to transfer a toner image formed on the image carrier to a recording member sandwiched between the image carrier and the surface moving member or to the surface moving member, and a cleaning device that cleans toner on the image carrier by a cleaning blade. The image forming apparatus also includes at least a cleaning blade which is disposed to be opposed to an image carrier which carries an electrostatic latent image and on which a toner image developed with developer is formed, and a blade supporting member for the cleaning blade; and a detector that observes vibrations of the cleaning blade coming into contact with the image carrier or the supporting member to calculate an index value based upon a normal condition using multi-dimensional data for each frequency obtained according to Fourier transform of the vibrations as signals, thereby detecting abnormality of a condition of contact of the cleaning blade with the image carrier such as presence of adhesion material or damage to the image carrier.

The other objects, features, and advantages of the present invention are specifically set forth in or will become apparent from the following detailed description of the invention when read in conjunction with the accompanying drawings.

DETAILED DESCRIPTION

Exemplary embodiments of a detector, a cleaning device, a process cartridge, and an image forming apparatus according to the present invention will be explained in detail with reference to the accompanying drawings.

Figure 1:
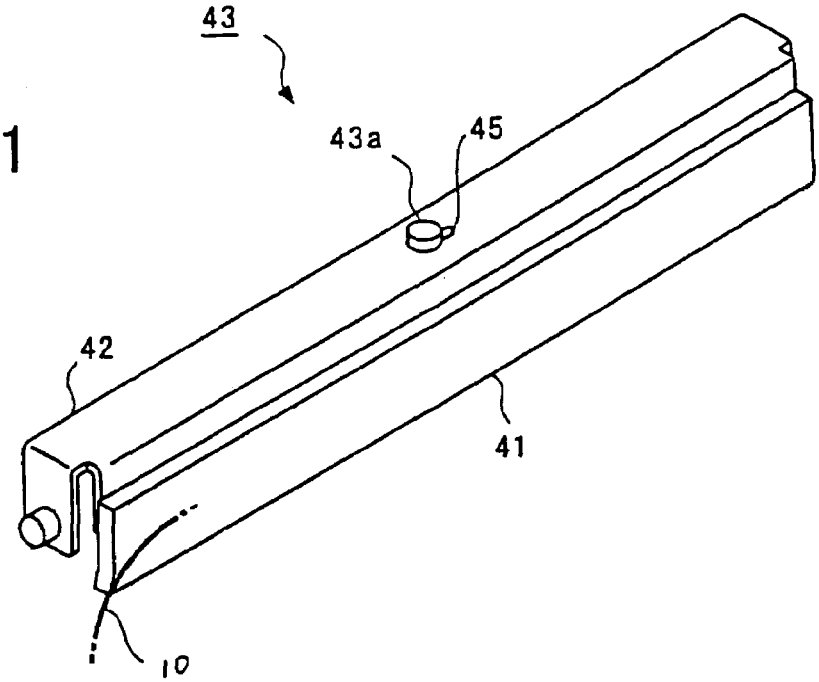
FIG. 1 is a perspective of a detector according to an embodiment of the present invention.

FIG. 1 is a detector 43 according to an embodiment of the present invention. The detector 43 includes a piezoelectric element (so-called "an acceleration pickup") serving as a detecting unit (not shown) and disposed on a blade supporting member 42 which supports a cleaning blade 41 made of elastomer and caused to abut on a photoconductor 10 serving as a rotating member. The piezoelectric element may be provided on a surface of the cleaning blade 41. A signal is transmitted from the piezoelectric element to a controller (not shown) provided in a main unit of an image forming apparatus 500 (see FIG. 3) through a signal line 45.

Figure 2:
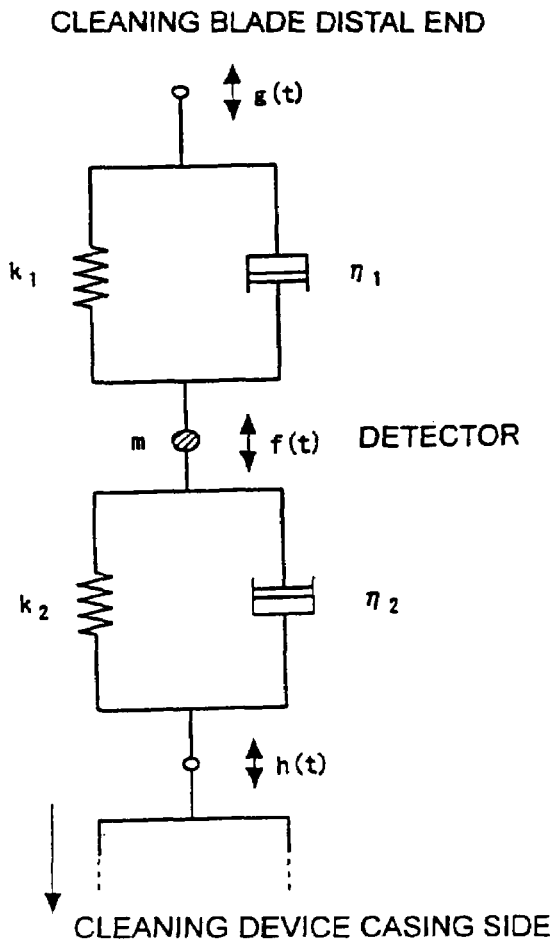
FIG. 2 is a model example of a relationship between vibrations of a distal end of a cleaning blade and vibrations observed by a piezoelectric element.

FIG. 2 is an example of a model of a relationship between vibrations of a distal end of a cleaning blade and vibrations observed by a piezoelectric element. In general, a model for vibration transmission is represented by a spring (a constant: k) and a dash pot (a constant: $\eta$) connected in parallel. When the detecting unit is disposed on the blade supporting member 42, strictly speaking, the cleaning blade 41 and the blade supporting member 42 should be respectively represented by models having individual characteristics, but they are collectively represented here for simplification of explanation.

What should be basically observed is a condition of fine stick slip with the photoconductor 10 (an image carrier) or an intermediate transfer member 51 (an image carrier) occurring at a distal end of the cleaning blade 41, but the condition cannot be directly observed by optical observing means, since light from the optical observing means is interrupted due to an abutting angle of the cleaning blade 41 or toner adhered thereto. Therefore, such a method is employed to observe vibrations of the blade supporting member 42. Vibrations occurring at the distal end of the cleaning blade 41 are damped due to characteristics of material for the cleaning blade 41, where, especially, vibration components in a high frequency range thereof are difficult to be transmitted. On the other hand, since the blade supporting member 42 is generally made from material with a relatively high rigidity and a low vibration-damping performance, such as a metal plate, and a swinging fulcrum is provided on a casing or process cartridge 101 (FIG. 15) having many movable members, vibrations of the movable members are transmitted to the blade supporting member 42. As a result, vibrations observed by the piezoelectric element arranged on the blade supporting member 42 form a waveform obtained by synthesizing vibrations due to the stick slip phenomenon occurring at the distal end of the cleaning blade 41 where vibration components in the high frequency range have been damped and vibrations of the movable members transmitted from the casing or the like.

Figure 3:
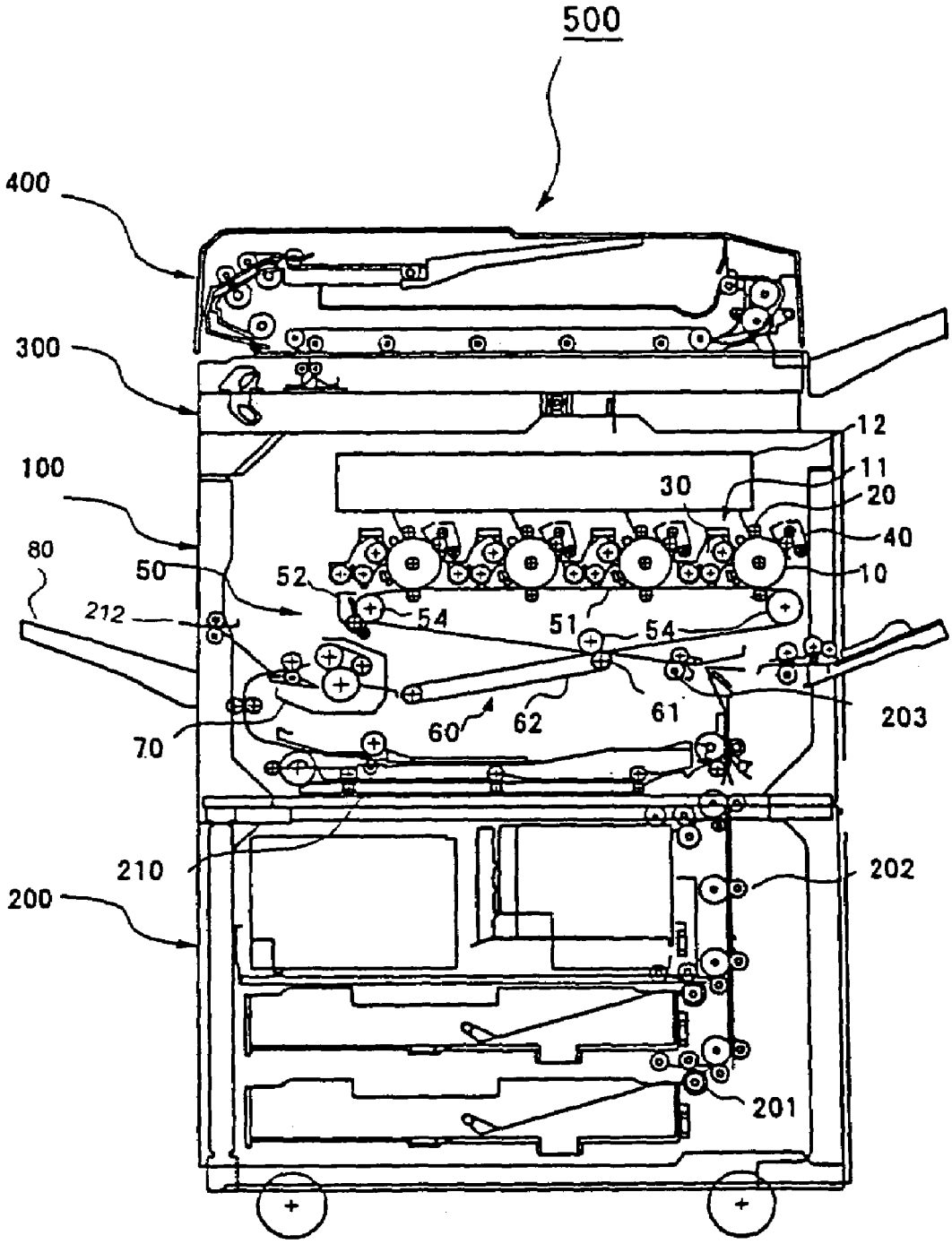
FIG. 3 is a side view of an image forming apparatus that includes the detector shown in FIG. 1.

FIG. 3 is a side view of the image forming apparatus 500 to which the detector 43 according to the present invention is applied. In general, this type of apparatus is called "a tandem type", and the image forming apparatus 500 is suitable for forming a color image and is configured to remove transfer residual toner remaining on a photoconductor 10 after a primary transfer by a photoconductor cleaning device to clean a surface of the photoconductor 10 for the following image forming operation. Transfer residual toner remaining on the intermediate transfer member 51 after a secondary transfer is removed by an intermediate transfer member cleaning device 52 so that a surface of the intermediate transfer member 51 is cleaned for the following image forming operation.

In FIG. 3, reference sign 100 denotes an image forming unit, 200 denotes a paper feeding unit on which a stack of transfer paper is loaded, 300 denotes a scanner mounted on the main unit of the image forming apparatus 500, and 400 denotes an automatic document feeder (ADF) equipped on the scanner 300, which serves as an original document feeding unit. An endless intermediate transfer belt 51 serving as the intermediate transfer member 51 is provided at a center of the main unit of the image forming apparatus 500.

The intermediate transfer belt 51 is configured of a base layer, an elastic layer, and a covering surface layer with a favorable smoothness. As shown in FIG. 3, the intermediate transfer belt 51 is entrained around three supporting rollers 54 and can be rotationally conveyed in a clockwise direction on the shown example. In the example shown in FIG. 3, the intermediate transfer member cleaning device 52 that removes residual toner remaining on the intermediate transfer belt 51 after transfer is provided on the left of the supporting roller 54 of three supporting rollers which is positioned on the left side. The tandem type image forming apparatus 500 is configured by arranging four image forming units 11 corresponding to yellow, cyan, magenta, and black above the intermediate transfer belt 51 spanned between the supporting roller 54 of three supporting rollers on the right side and the supporting roller 54 on the left side along a conveying direction of the intermediate transfer belt 51 in a tandem manner. As shown in FIG. 3, an exposing device 12 is further provided above the image forming units 11. In the tandem type image forming apparatus 500, the individual image forming units 11 are provided around the drum-shaped photoconductor 10 with a charging device 20, a developing device 30, a primary transfer device 50, a photoconductor cleaning device 40, a charge removing device (not shown), and the like.

On the other hand, a secondary transfer device 60 is provided on an opposite side of the tandem type image forming apparatus 500 via the intermediate transfer belt 51. In the shown example, the secondary transfer device 60 has a configuration that a conveying belt 62 which is an endless belt is spanned between two transfer rollers 61, and the conveying belt 62 is disposed so as to be pressed on the third supporting roller 54 via the intermediate transfer belt 51 so that an image on the intermediate transfer belt 51 is transferred on a sheet which is a recording member.

A fusing device or fuser 70 fixing a transferred image on a sheet is disposed adjacent to the secondary transfer device 60. The fusing device 70 is configured so as to press a pressure roller against a fusing belt (not shown) which is an endless belt. The secondary transfer device 60 is provided with a sheet conveying function which conveys a sheet transferred with an image to the fusing device 70. Needless to say, a transfer roller 61 or a non-contact type charger may be disposed as the secondary transfer device 60. In such a case, it will be difficult to provide the sheet conveying function to the secondary transfer device 60.

Further, a sheet reversing device 210 that reverses a sheet for recording images on both surfaces of the sheet can be provided below the secondary transfer device 60 and the fusing device 70 in parallel to arrangement of the image forming apparatus 500.

An operation of the tandem type image forming apparatus 500 will be explained below. When copying is performed using the tandem type image forming apparatus 500, an original is set on an original table of the original automatic document feeder 400. Alternatively, the original automatic document feeder 400 is opened and an original is set on a contact glass of the scanner 300 so that the original is pressed on the contact glass by closing the original automatic document feeder 400. When a start switch (not shown) is pushed, after the original set in the original automatic document feeder 400 is conveyed to the contact glass, the scanner 300 is driven, or when the original is set on the contact glass, the scanner 300 is immediately driven, so that read light is inputted into a reading sensor through an imaging lens to read contents of the original.

One of the supporting rollers 54 is rotationally driven by a driving motor (not shown) to rotate the remaining two supporting rollers 54 in a depending manner to rotationally convey the intermediate transfer belt 51. Simultaneously, in image forming units 11, single color images of black, yellow, magenta, and cyan are formed on the respective image forming units 11 while the image forming units are being rotated. The single color images are sequentially transferred on the intermediate transfer belt 51 according to conveyance of the intermediate transfer belt 51 to form a composed color image on the intermediate transfer belt 51.

On the other hand, one of a plurality of pickup rollers 201 in the paper feeding unit 200 is selectively rotated to feed sheets from one of paper feeding cassettes arranged in a multiple-tier configuration, and the sheets are separated to be inserted into a paper feeding path one by one. Each sheet is conveyed by a conveying roller pair 202 to be guided in the image forming unit 100 where the sheet abuts a registration roller pair 203 to be stopped. The registration roller pair 203 is rotated in synchronization with a composed color image on the intermediate transfer belt 51 and a sheet is fed in between the intermediate transfer belt 51 and the secondary transfer device 60 so that the color image is recorded on the sheet by transfer conducted in the secondary transfer device 60. The sheet on which the image has been transferred is conveyed by the conveying belt 62 and fed into the fusing device 70, where a transferred image is fused by heat and pressure. Thereafter, the sheet with the transferred image is discharged by a discharging roller pair 212 so that it is stacked on a paper discharge tray 80. Incidentally, the order of colors forming an image is not limited to a specific one, but it can be modified depending on a feature or a characteristic of the image forming apparatus 500.

On the other hand, after image transfer, residual toners on the photoconductors 10 and the intermediate transfer belt 51 are removed by the photoconductor cleaning devices 40 and the intermediate transfer member cleaning device 52 for the following image forming operation in the tandem type image forming apparatus 500.

The cleaning blade 41 in the photoconductor cleaning device 40 is hence arranged so as to be put into contact with the photoconductor 10 that moves on a distal end ridge of the cleaning blade 41 with a predetermined load. The cleaning blade 41 is formed in a flat plate and it may be made from elastic material such as polyurethane rubber. The distal end ridge of the distal end portion of the cleaning blade 41 projecting from the distal end portion of the blade supporting member 42 toward the photoconductor 10 by a predetermined projecting amount is brought into contact with the photoconductor 10 so that the distal end intercepts residual toner on the surface of the photoconductor 10 to scrape off the toner. At this time, releasing agent, being a constituent component in developer, which has been subjected to strong stress gradually moves to the photoconductor 10 and the releasing agent is adhered on the photoconductor 10 by pressure of the cleaning blade 41 like a thin film, which is called "filming". Besides, additive in the developer releases to adhere on the photoconductor 10. The additive or fine powder of the crushed developer is then caused to firmly adhere to the surface thereof by pressure of the cleaning blade 41, and developer further adhere and grow to form black points on the surface of the photoconductor 10, which is also called "filming".

Figure 4:
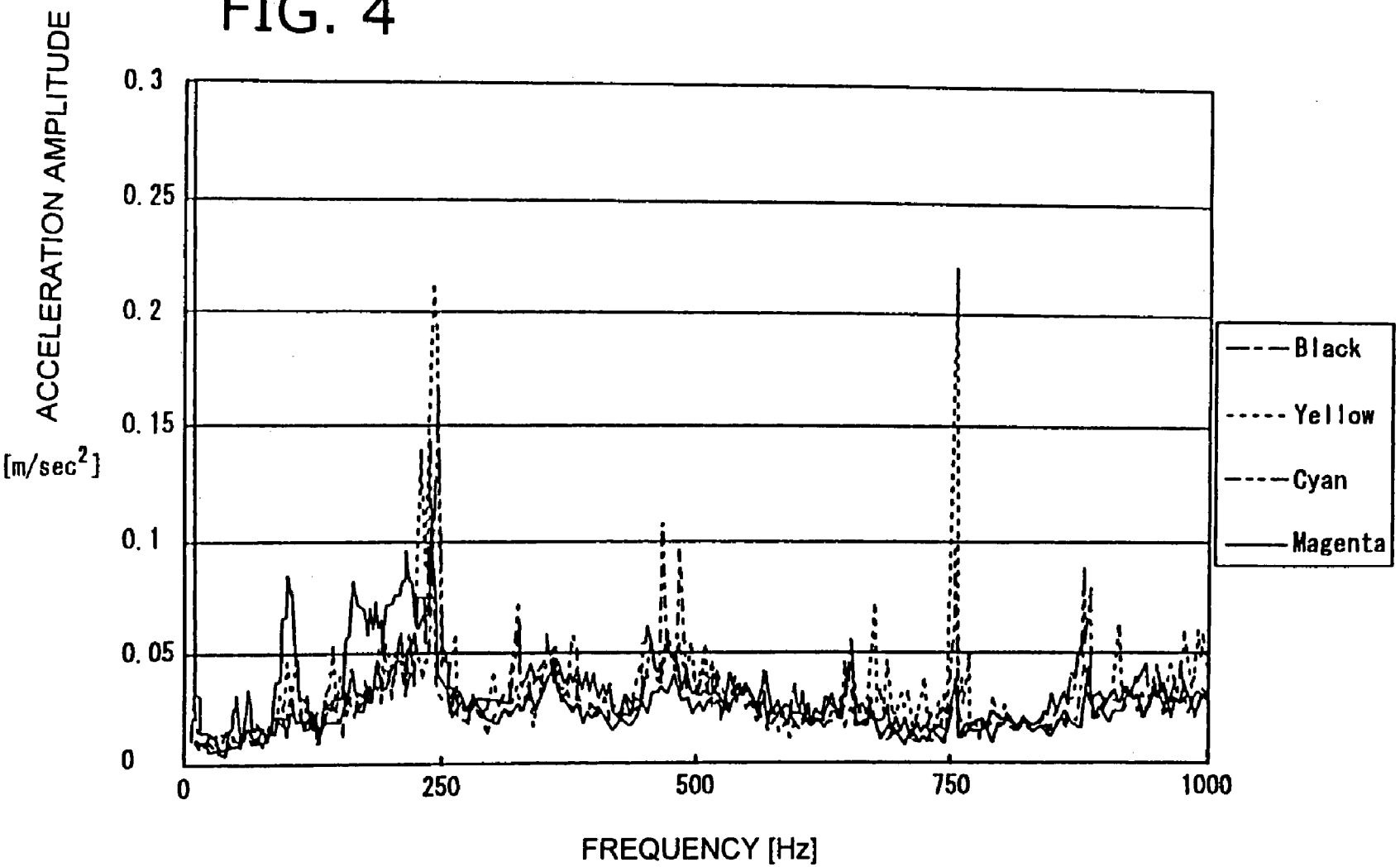
FIG. 4 is a graph of the result obtained by performing frequency-analysis (FFT analysis) on an output waveform of the piezoelectric element on a blade supporting member.

FIG. 4 is a graph of the result obtained by frequency analysis (FFT analysis) of an output waveform of the piezoelectric element mounted on the blade supporting member 42. Image forming is performed using the image forming apparatus 500, where change of signals from the detector 43 is read out. Filming has occurred on the photoconductors 10 corresponding to Cyan and Magenta, but it has not been developed yet on the photoconductors 10 corresponding to Black and Yellow.

Figure 5:
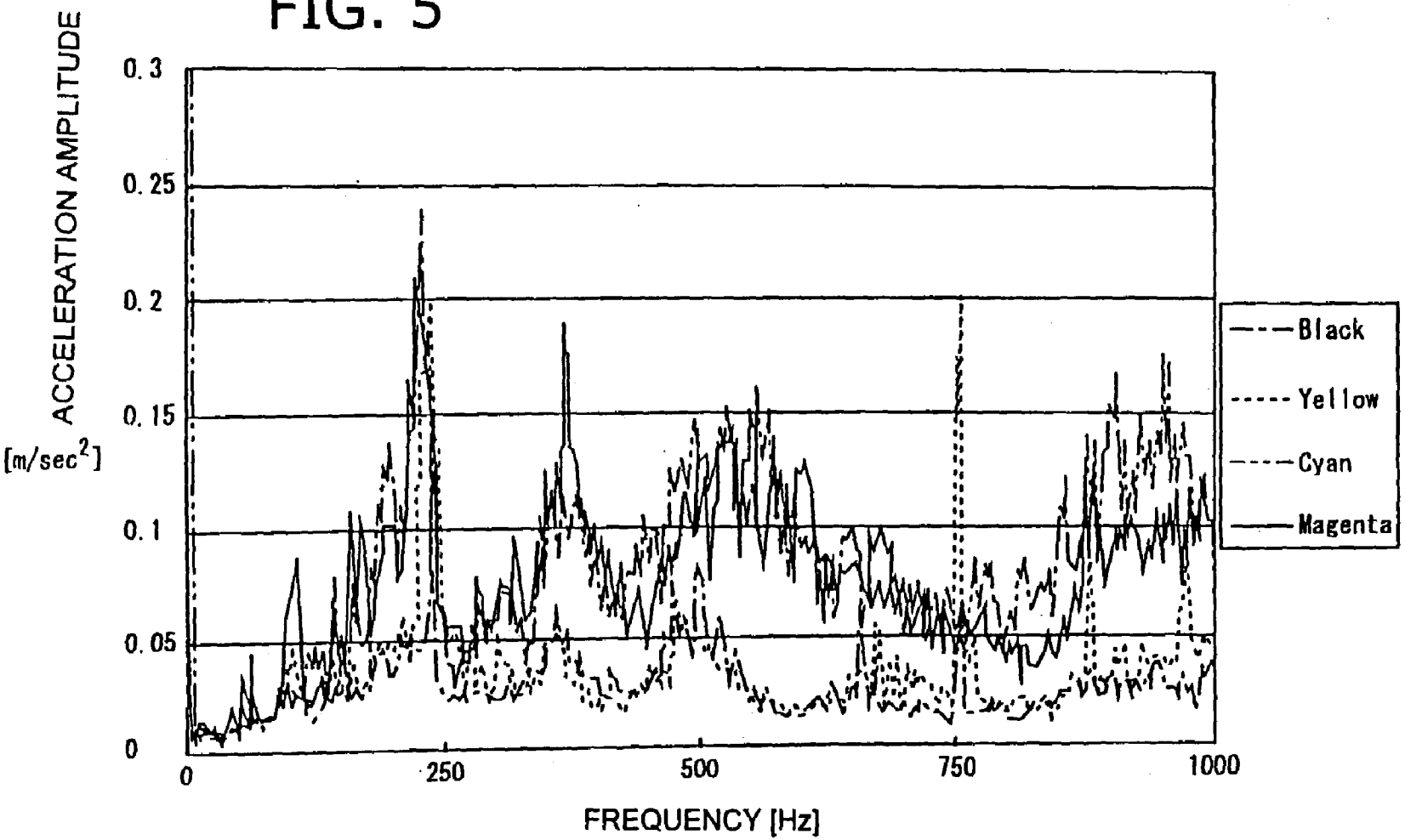
FIG. 5 is a graph of the result obtained by performing frequency-analysis (FFT analysis) of an output waveform of the piezoelectric element after photoconductors (for Cyan and Magenta) with filming have been replaced with other photoconductors.

FIG. 5 is a graph of the result obtained by frequency analysis (FFT analysis) of an output waveform of the piezoelectric element after the photoconductors 10 (Cyan and Magenta) with filming have been replaced with other photoconductors 10. From the comparison between FIG. 4 and FIG. 5, it is understood that large change occurs especially in a frequency band of 500 Hz or more. It is shown that correlation with the filming is low in the frequency band and resonance of the blade supporting member 42 appears. Besides, some characteristic peaks are observed. However, since a correlation relationship between acceleration amplitude of a specific peak frequency and presence of filming cannot be confirmed, filming detection based upon peak frequency monitoring, which is a general analyzing method, will not be effective.

Figure 6:
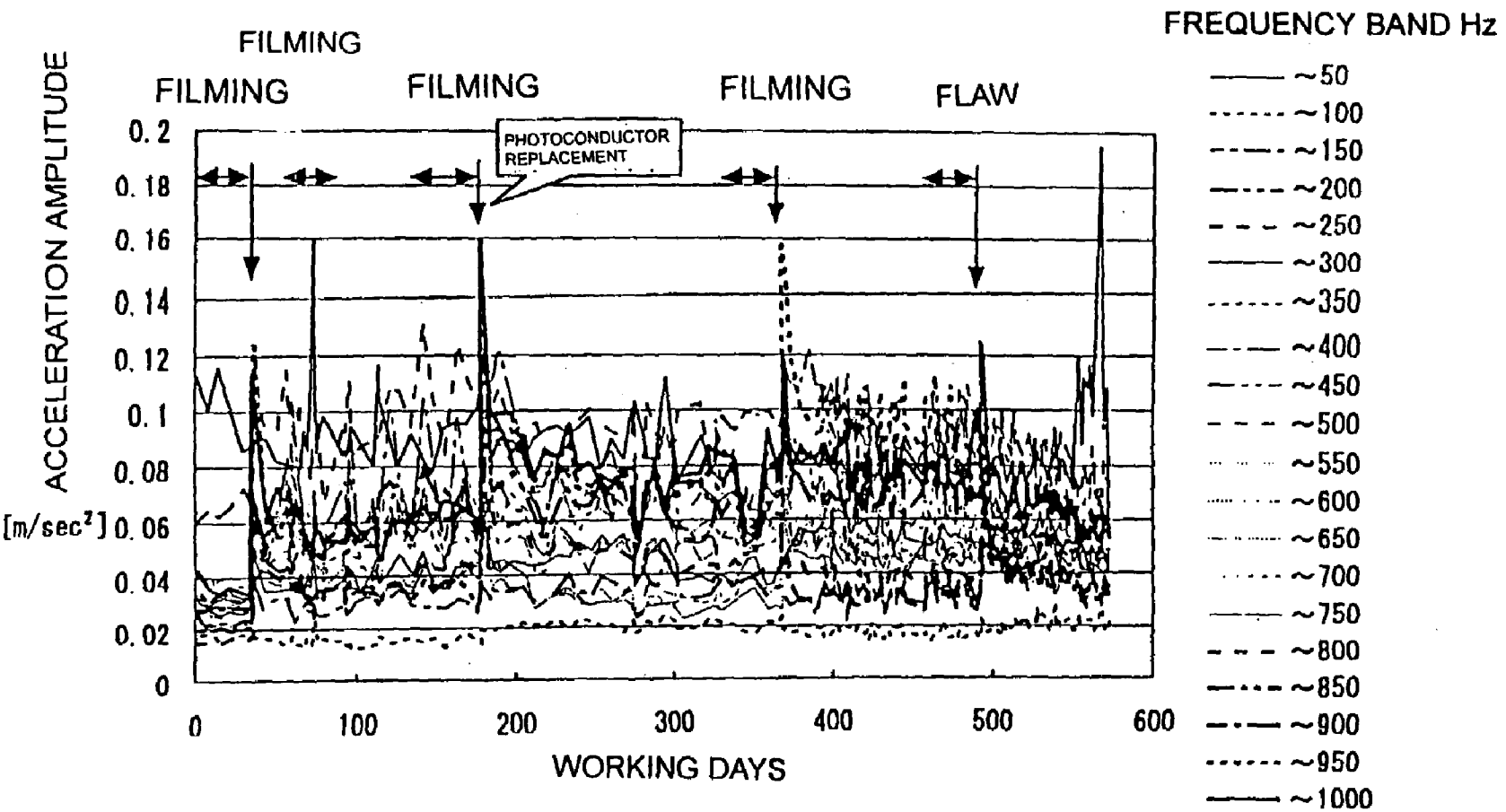
FIG. 6 is a graph of a frequency analysis of an output waveform obtained when developing is performed with cyan toner in time series.

FIG. 6 is a graph of a frequency analysis of an output waveform obtained when developing is performed with cyan toner in time series. As shown in FIG. 6, the graph is divided into some frequency bands and corresponding relationships between the time series change of the acceleration amplitude and occurrence of filming in the respective sections are shown. It is understood that similar change is not obtained necessarily depending on the frequency band. The amplitude change appears largely in a high frequency band, but correlation with the filming is small, as described above.

Figure 7:
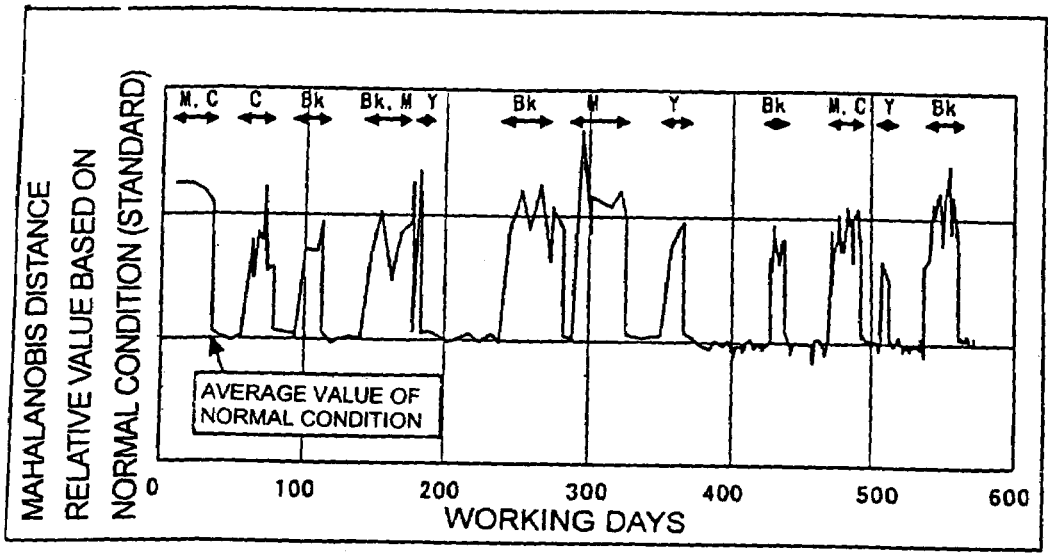
FIG. 7 is a graph of a corresponding relationship between time series change of Mahalanobis distance and filming.

FIG. 7 is a graph of a corresponding relationship between time series change of Mahalanobis distance and filming using the Mahalanobis distance as an example of an index value. Acceleration amplitudes in a low frequency band are obtained regarding all the color, and Mahalanobis distances (strictly speaking, a square distance) based upon a normal condition where filming does not occur are calculated from the multi-dimensional data thus obtained (this approach is called "MT process"). The calculation results are compared corresponding to generated filming conditions. In the normal condition where no filming occurs, the Mahalanobis distance becomes about 1 to 3. The Mahalanobis distance increases according to occurrence of filming, from which detection of occurrence of filming and prediction of the occurrence can be made by observing the Mahalanonbis distance. The Mahalanobis distance is one evaluation method for pattern recognition, but the index value to be calculated is not limited to this value.

Filming did not occur on the photoconductor 10 evenly but occurred partially or ubiquitously. From the experimental results, it is found that change in vibrating condition due to change of partial friction can be detected by one point vibration observation, which means that, since the cleaning blade 41 or the supporting member 42 has a relatively simple vibration mode, vibration waveform change corresponding to filming is developed without depending too much on a distance from an observing point.

By evaluating the same Mahalanobis distance, not only the filming but also vibrations of cleaning blade 41 and the blade supporting member 42 are analyzed so that frictional condition change between the cleaning blade 41 and the photoconductor 10 can be read. Therefore, cleaning inferiority due to toner passing, turning-up of the cleaning blade 41, vibrations of the cleaning blade 41, lowering of contacting pressure due to wearing of a distal end of the cleaning blade 41 can be detected by reading corresponding relationship among respective Mahalanobis distances.

Thus, since downsizing and weight saving, as well as a stable sensitivity over a wide range can be achieved, it is unnecessary to optimize a configuration for each machine type. A detector 43 with remarkably reduced system disturbances can be provided. With such analysis, multi-dimensional data of vibration frequencies is observed through substitution of the data with one scale without largely reducing an information amount, so that change of vibrations corresponding to a worn condition of the cleaning blade 41 can be grasped correctly, and detection of abnormality such as filming or cleaning inferiority can be made. Filming which occurs partially can be detected and multiple points observation becomes unnecessary.

Figure 8:
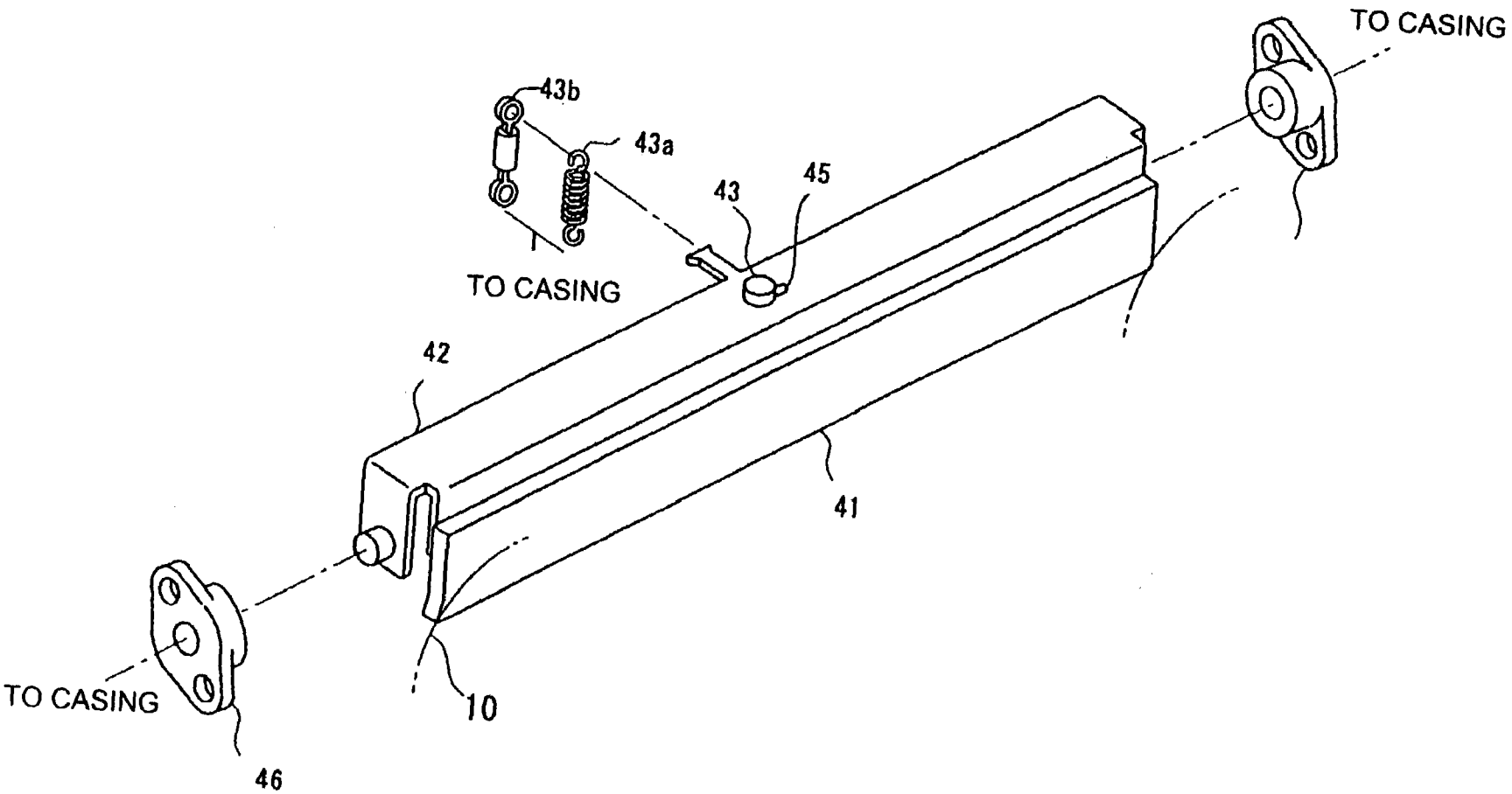
FIG. 8 is a perspective of a detector according to another embodiment of the present invention.
Figure 9:
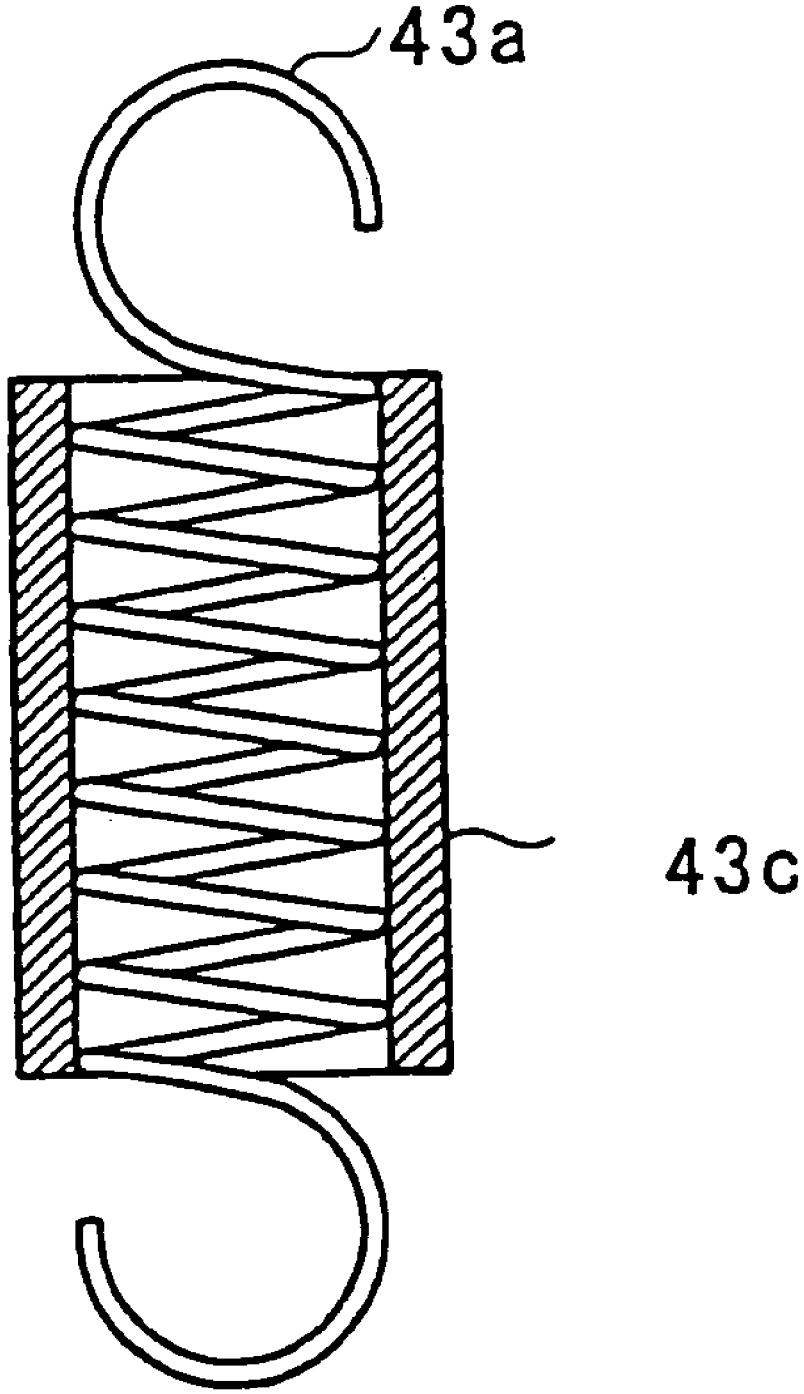
FIG. 9 is a side view of a detector according to still another embodiment of the present invention.
Figure 10:
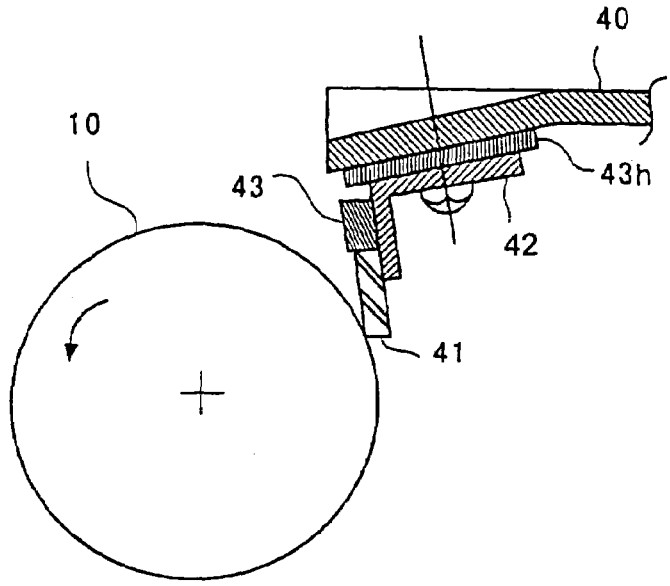
FIG. 10 is a cross sectional view of a detector according to still another embodiment of the present invention.

FIGS. 8, 9, and 10 are schematic diagrams of configurations of the detector 43 that observes vibrations of a cleaning blade 41 based upon change of an electrostatic capacity of parallel electrode plates.

As shown in FIG. 8, vibration transmission from a casing side of the cleaning device 40 is suppressed so that vibration transmission from the cleaning blade 41 is relatively increased. A swinging fulcrum (a supporting shaft) of the blade supporting member 42 is supported by a damper 46 of a rotary type. In general, a movable member such as a gear is disposed at an end portion of each member. Since the supporting shaft of the blade supporting member 42 is disposed very close to such a movable member, vibrations which cause noises are easily transmitted. However, since influence of vibrations from the movable member disposed just near is suppressed by the damper 46, noises are blocked from entering in the detector 43. A rotational angle of the supporting shaft is remarkably small, and an allowable range of viscosity torque is large. Accordingly, it is made possible to set a large damping allowability.

As shown in FIGS. 8 and 9, a damper 43*b* is arranged in parallel to a spring 43*a* which is a pressurizing unit for the cleaning blade 41, or visco-elastic member such as a rubber 43*c* is wound on a coil portion of the spring 43*a*. As a result, vibrations transmitted from the casing to the blade supporting member 42 can be damped over a wide band range, and detection ability for frictional condition change at the distal end of the cleaning blade 41 can be improved. Since vibrations generated from such a movable member as a gear are suppressed from transmission to the blade supporting member 42, signal components from the distal end of the cleaning blade 41, which occupies the vibration waveforms, is relatively increased so that detection ability for change of conditions can be improved.

Figure 11:
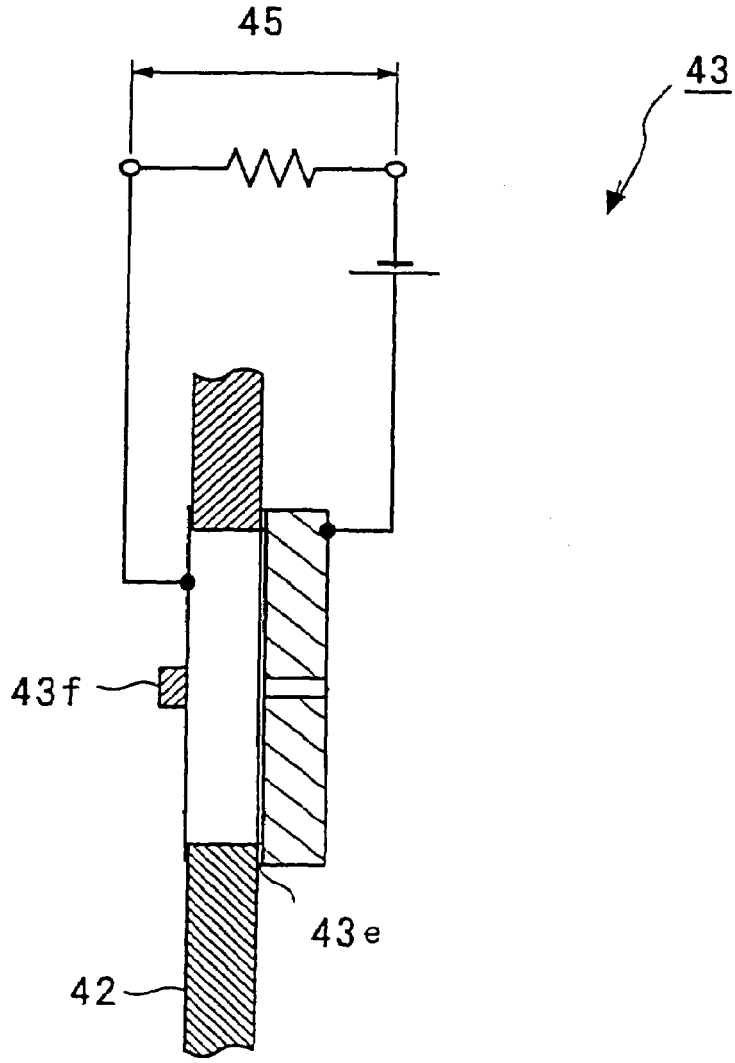
FIG. 11 is a cross sectional view of a detector according to still another embodiment of the present invention.

As shown in FIG. 10, in an image forming apparatus 500 (shown in FIG. 3) with a small size and a low processing speed, there is a type where the blade supporting member 42 is fixed to the casing of the cleaning device 40 or the process cartridge 101 (shown in FIG. 15) without using a pressurizing spring 43*f* (shown in FIG. 11). In this case, a vibration suppressing member 43*h* is interposed between the blade supporting member 42 and the casing of the cleaning device 40, or the vibration suppressing member 43*h* is adhered to a flat face of the blade supporting member 42, so that vibration transmission can be suppressed.

With the detector 43, a simple configuration can be made and matching of sensitivity with low frequency vibrations correlated with filming can be achieved. Even when the blade supporting member 42 is fixed to the casing, noises (unnecessary vibrations) from the casing can be suppressed from entering in the detector 43 and a detection precision in a small sized image forming apparatus can be improved. Since the vibration suppressing member 43*h* corrects fluctuation of a contacting condition of the cleaning blade 41 with the photoconductor 10, an unstable operation can be avoided.

FIG. 11 is a schematic diagram of an example of a unit that converts vibrations of a cleaning blade 41 to electric signals to detect filming other than the piezoelectric element.

A detector 43 is configured by providing a pair of parallel flat plate electrodes on the blade supporting member 42 and making at least one of the electrodes as a vibration plate 43*h* such as a thin film vibrated easily. The vibration plate 43*h* may have a cantilever structure provided with a weight 43*f* as needed. By providing the configuration on the cleaning blade 41 or on the blade supporting member 42, vibrations with relatively low frequencies occur in the vibration plate 43*h* and an electrostatic capacity between the electrodes changes in a course of time. By taking out the change as signals, vibration observation is made possible. Thereby, noises (unnecessary vibrations) due to surging of the pressurizing spring 43*a* provided at a central flat plate portion of the blade supporting member 42 to which vibration noises easily advances can be suppressed.

Figure 12:
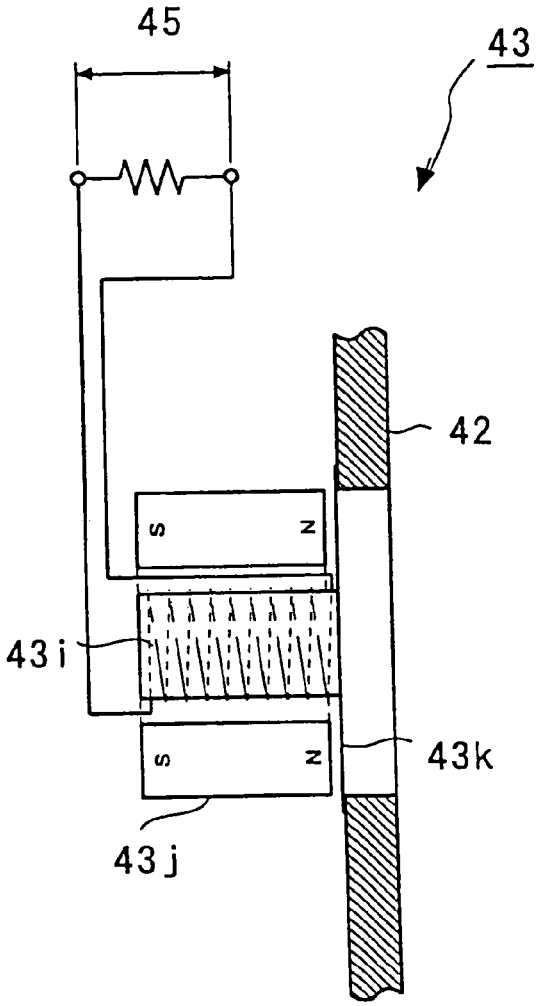
FIG. 12 is a schematic diagram of a detector according to still another embodiment of the present invention.

FIG. 12 is a schematic diagram of a configuration of another detector 43 that observes vibrations of a cleaning blade 41.

A light weight coil 43*i* (a voice coil) is provided on a vibration plate 43*k*. When a magnet 43*j* having a flux penetrating into the coil 43*i* is provided around or in the coil 43*i*, current flows in the coil vibrating due to electromagnetic induction, so that vibration observation is made possible by detection of the current.

With the detector 43, a simple configuration is made, and metallic foreign materials causing a flaw resulting in fatal defect of the photoconductor 10 can be blocked from entering in the cleaning device 40 by utilizing magnetic force of a magnet.

Besides, though not shown, a method which observes fine displacement of the cleaning blade 41 or the blade supporting member 42 using an optical displacement measuring unit can be utilized. In this case, since a light source or a light detecting unit can be arranged on a side of the main unit. Accordingly, there is an advantage that the cost for the cleaning blade 41, which is relatively frequently replaced, will not be increased. With the detector 43, it is made possible to arrange both the light source and the detecting unit and it is made unnecessary to provide a vibration detecting unit on the side of the cleaning blade 41. Therefore, the maintenance cost can be suppressed as the cost increase of the cleaning blade 41, which is replaced relatively frequently, can be avoided.

Figure 13:
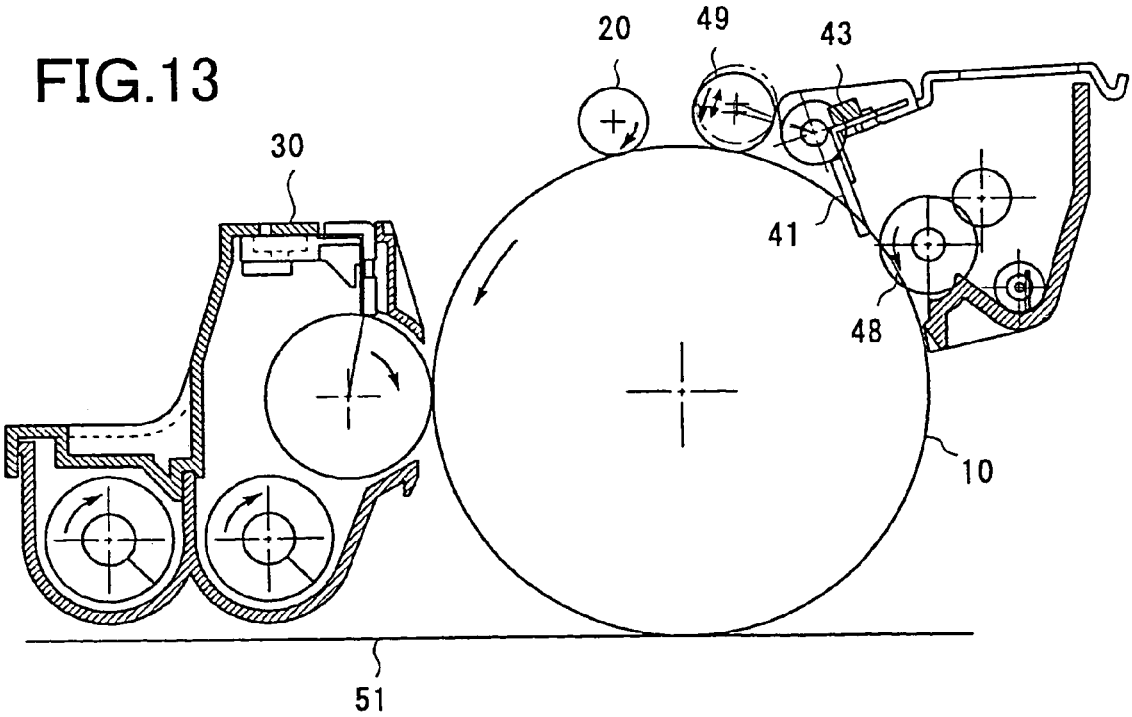
FIG. 13 is a schematic diagram of an image forming apparatus provided with a filming removing unit.

FIG. 13 is a schematic diagram of a configuration of an image forming apparatus 500 provided with a filming removing unit.

Vibrations of the cleaning blade are detected and analyzed and increase of the Mahalanobis distance is detected in the detector 43. When it is detected that filming of toner occurs on the photoconductor 10, the filming is removed by the filming removing unit 48 provided in the image forming apparatus 500.

A filming removing roller 49 serving as the filming removing unit is provided downstream of the cleaning blade 41 so as to contact on/separate from the photoconductor 10. As material for the filming removing roller 49, melamine foam of an open cell type develops favorable removing performance. However, since the foam itself easily wears, durability thereof lowers. Therefore, while the Mahalanobis distance is sequentially calculated from vibration data detected, increase thereof is monitored. An operation of the filming removing roller 49 starts based upon of a time when the Mahalanobis distance from a condition before detection of an abnormal image reaches an operation starting condition, for example about 3 to 5 centimeters, and the filming removing roller 49 is caused to abut on the photoconductor 10 to be rotated at the time when the Mahalanobis exceeds the operation starting condition. Thus, operation of the filming removing roller 49 is controlled by using the Mahalanobis distance as the criterion and setting condition having the Mahalanobis distance to a state before development of image failure, so that a preventive action can be performed. Therefore, a period elapsing until an image failure is developed can be extended, which results in extension of the life of the photoconductor 10 in theory. Since measurement can be performed before an abnormal image due to filming is developed, a high durability of the filming removing roller 49 can be realized. Furthermore, an operation time of the melamine foam with a high filming removing performance is suppressed to a minimum range required, so that the durability of the melamine foam can be improved in theory. Alternatively, since the filming removing roller 49 can be configured of a roller with a smaller diameter, the image forming apparatus 500 can be further downsized.

Figure 14:
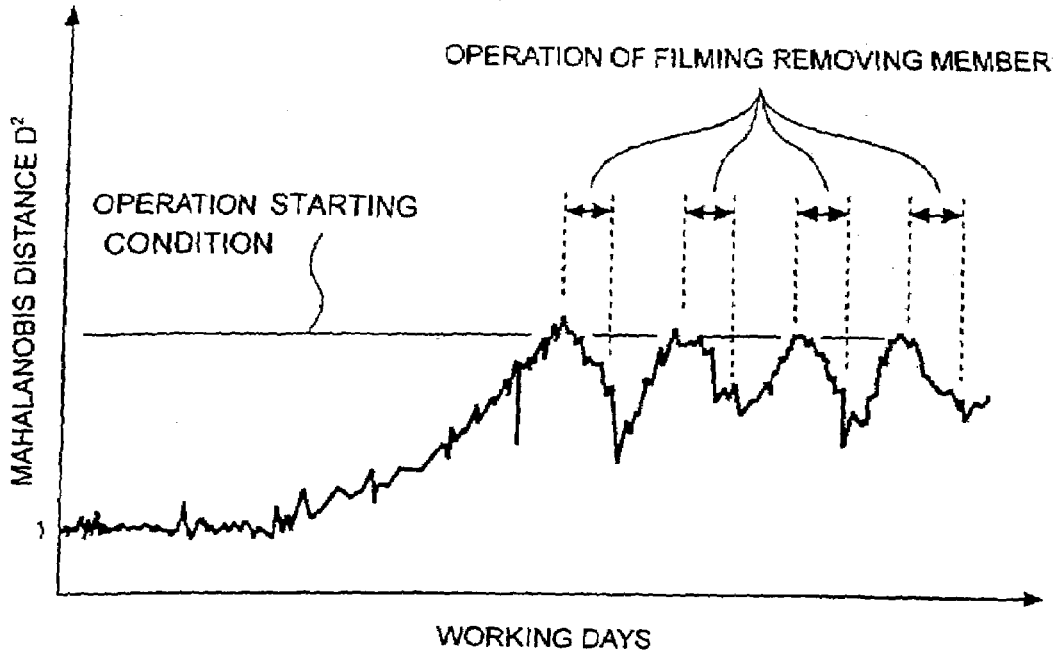
FIG. 14 is a graph of a time series analysis of Mahalanobis distance in a color image forming apparatus.

FIG. 14 is a graph of a time series analysis of Mahalanobis distance in a color image forming apparatus. When the Mahalanobis distance becomes large, input of transfer residue toner to the cleaning device 40 increases in some cases. Since a fur brush is used as the film removing unit 48, serving as a cleaning brush, and is arranged as an auxiliary unit, filming can be removed by controlling the number of revolutions of the cleaning brush. There is a method which intentionally increases an amount of toner inputted into the cleaning device 40, where consumption of unnecessary toner can be avoided by applying the Mahalanobis distance to the operation starting condition. When reduction of an amount of toner inputted to the cleaning device 40, which is a filming occurring factor, is generated, increase of the Mahalanobis distance can be controlled by supplementing toner to be inputted into the cleaning blade 41.

When the Mahalanobis distance is increased even by operation of each filming removing unit 48, determination that the filming removing unit 48 has reached its life is made and substitution of the filming removing unit 48 with another fresh unit is performed. Therefore, it is made possible to take measurements before an image failure occurs and a downtime can be shortened remarkably.

Besides, by adding image forming condition data such as image area ratio or humidity/temperature to items for calculating the Mahalanobis distance, detection precision can further be improved and an optimal filming removing unit 48 or process can be selected.

Figure 15:
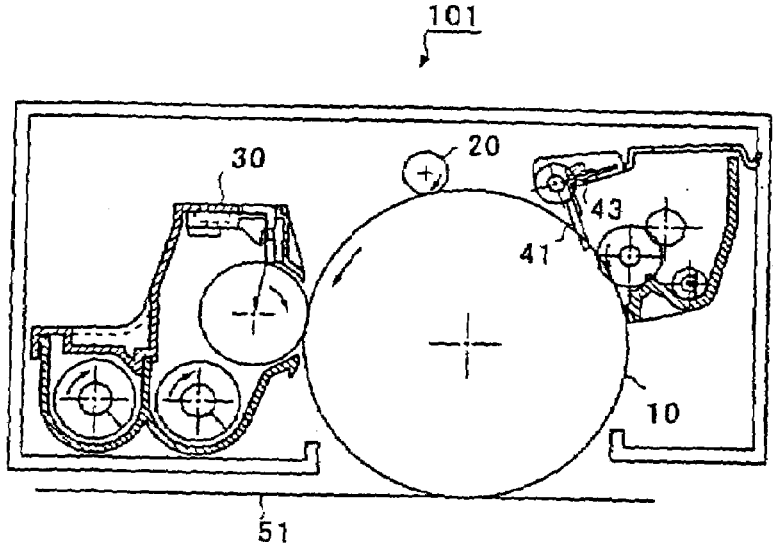
FIG. 15 is a schematic diagram of a process cartridge according to the present invention.

FIG. 15 is a schematic diagram of a configuration of a process cartridge 101 according to the present invention.

The detector 43 can be used in the process cartridge 101. Therefore, a long life of the photoconductor 10 and an extension of a cycle between the first maintenance to the next can be achieved. An image with a high quality which does not include background dirt due to cleaning failure can be obtained. In an image forming apparatus 500 provided with a plurality of process cartridges 101, the above advantage is further strengthened, and operability and maintainability can be improved considerably.

Figure 16:
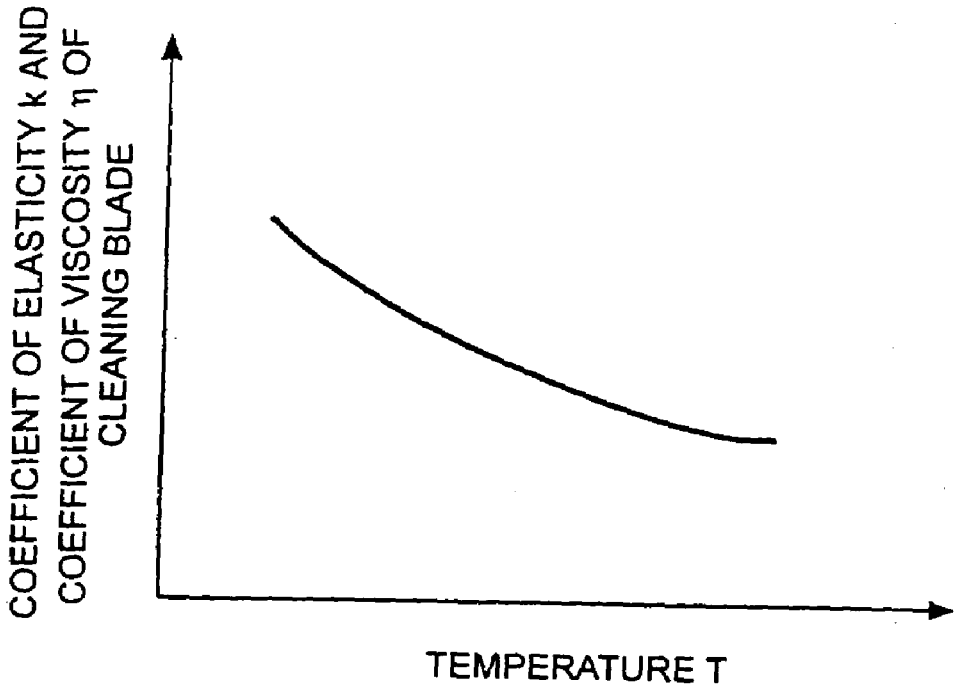
FIG. 16 is an illustrative diagram of a temperature dependency between elastic coefficient of a cleaning blade and coefficient of viscosity.

FIG. 16 is a graph of a temperature dependency of a coefficient of elasticity k and a coefficient of viscosity $\eta$ of the cleaning blade 41.

Figure 21:
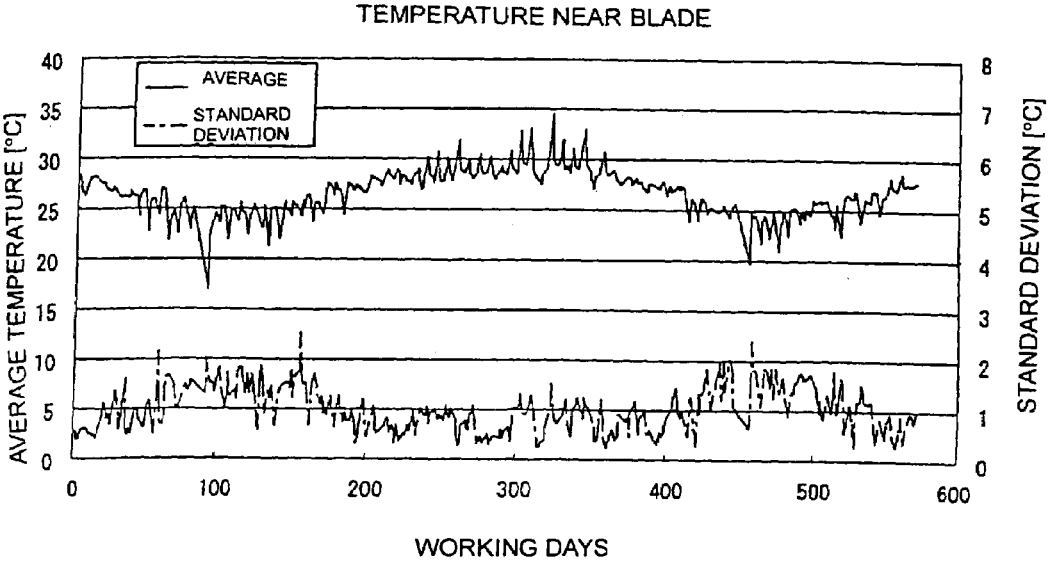
FIG. 21 is a graph of one example of a temperature transition near a cleaning blade.
Figure 22:
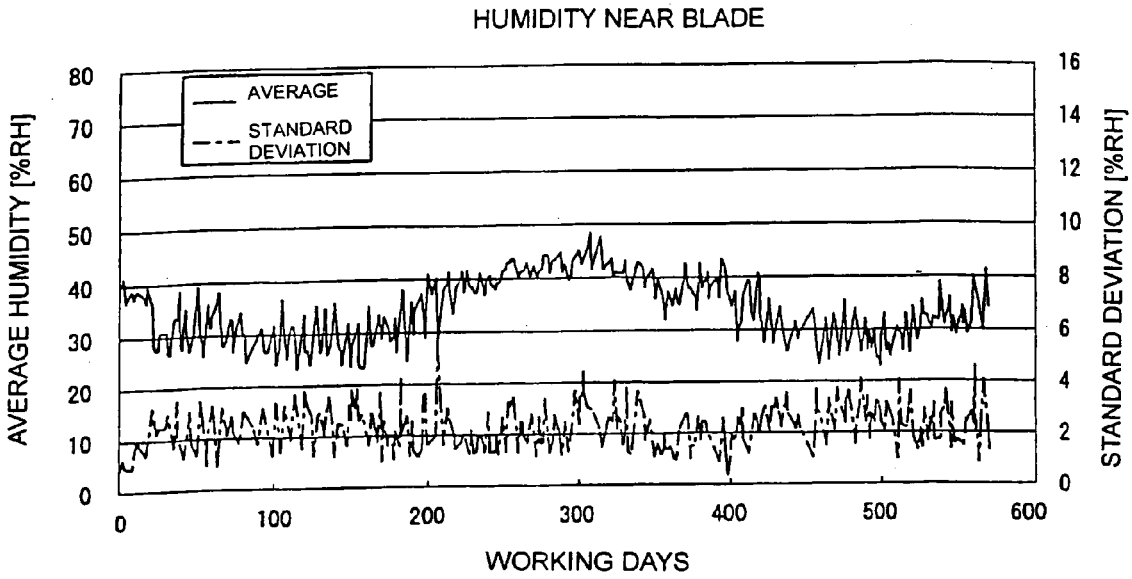
FIG. 22 is a graph of one example of a humidity transition near a cleaning blade.

As shown in FIG. 16, the cleaning blade 41 made from polymer material such as elastomer has a coefficient of elasticity k and a coefficient of viscosity T with a considerably high temperature dependency. In general, the image forming apparatus 500 is often installed in an office with air-conditioning equipment, where temperature/humidity inside the image forming apparatus 500 is put in a relatively stable condition. As shown in FIGS. 21 and 22, however, cyclic changes such as for each one year/one week/one day can be recognized. As a result, the vibration condition and the transmission characteristic of the cleaning blade 41 vary slightly. Regarding the humidity, although there is a difference in varying degrees, polymer material shows a hygroscopic property, and the visco-elasticity may be affected by humidity.

Figure 17:
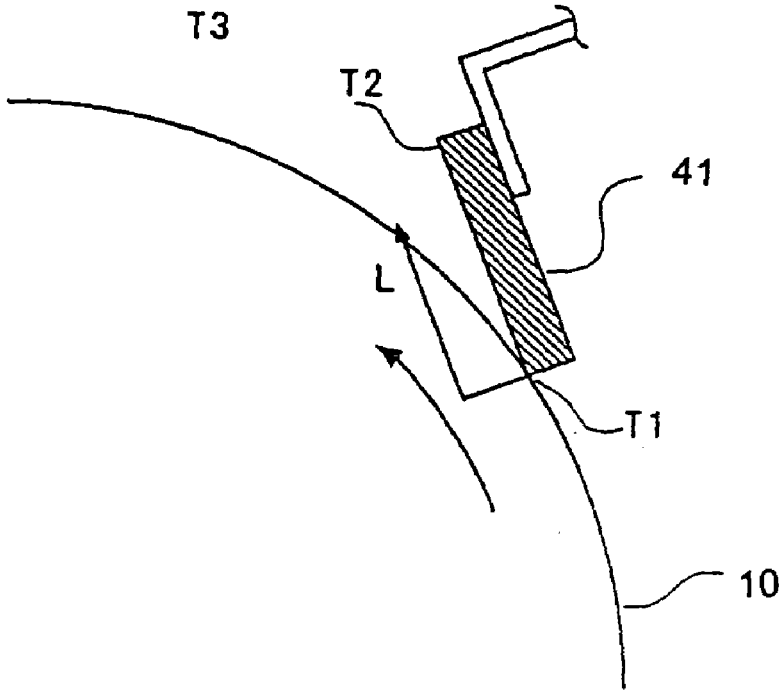
FIG. 17 is a schematic diagram of a condition of a cleaning blade which is caused to abut on a photoconductor.
Figure 18:
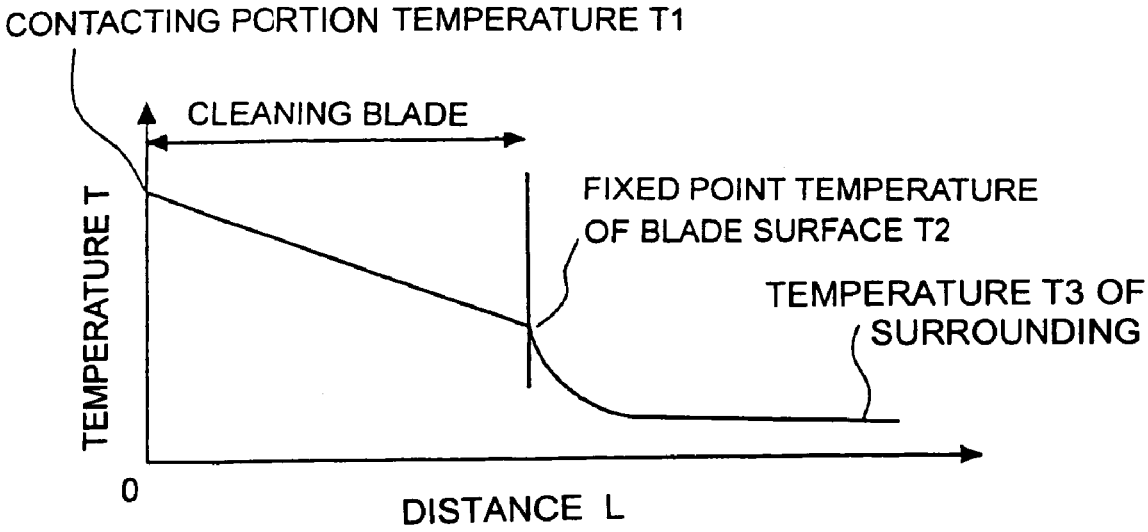
FIG. 18 is a schematic diagram of a temperature distribution to a distance from an abutting portion of a cleaning blade which abuts on a photoconductor.

FIG. 17 is a schematic diagram of a condition of the cleaning blade 41 brought into contact with the photoconductor 10. FIG. 18 is an illustrative diagram of a temperature distribution to a distance L from the contacting portion of the cleaning blade 41 which is brought into contact with the photoconductor 10. Instead of direct measurement of the visco-elasticity of the cleaning blade 41, correction is made by observing a temperature of the cleaning blade 41 or humidity in the vicinity thereof and examining a correlation thereof with vibration data (an index value is calculated by combining temperature/humidity data with a vibration data group). Since the material used for the cleaning blade 41 has a small thermal conductivity, a relatively large temperature difference occurs between the contacting portion which is a heat generating source and the other end, as shown in FIG. 18. Therefore, a temperature of a portion of the cleaning blade 41 positioned near the contacting portion, where a visco-elasticity varies largely, may be observed. As a specific method, a contacting type temperature sensor (a thermocouple or a thermistor) or a non-contacting type temperature sensor such as a thermo-pile is provided near the contact portion so that a temperature at the portion near the contact portion is observed.

In the image forming apparatus 500, since humidity/temperature near the photoconductor 10 is observed in order to maintain stable image forming, the information may be utilized. In this case, as shown in FIG. 18, a vicinity space temperature T3 is observed, where a time lag to temperature rising at the contacting portion is large. Therefore, data with a high correlation with the temperature at the contact portion can be obtained by using a moving average corresponding to a predetermined time.

Thus, since the index value is calculated with the blade temperature information which influences on the visco-elasticity of the cleaning blade 41, an abnormality detecting precision for cleaning can be improved. Since information is acquired from an existing temperature/humidity sensor in the image forming apparatus 500, improvement on abnormality detecting precision of the cleaning blade 41 can be achieved at a low cost.

Figure 19:
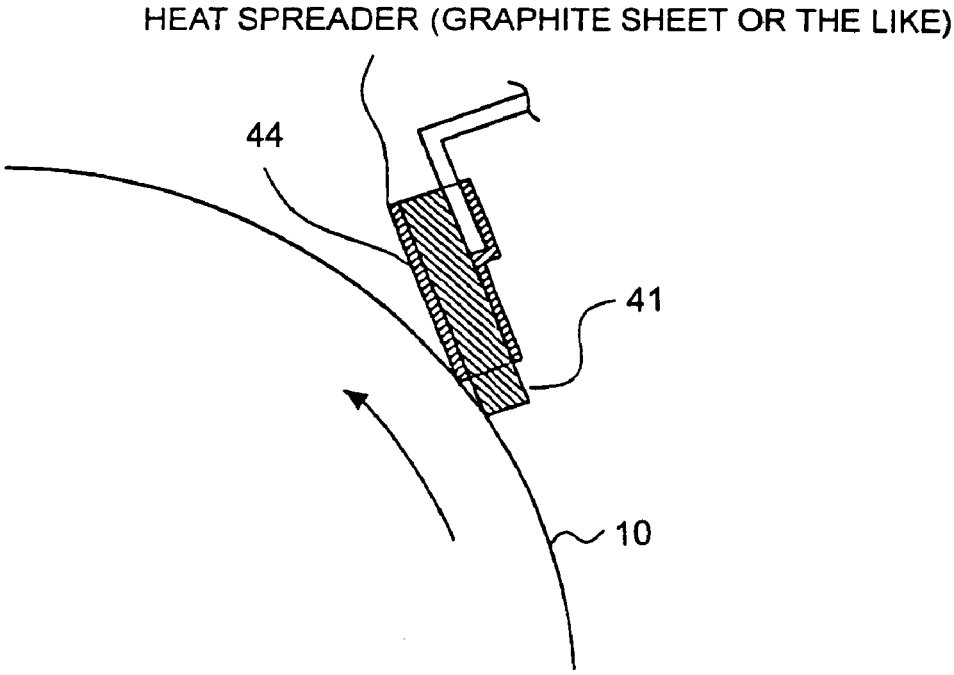
FIG. 19 is a schematic diagram of a configuration of a cleaning blade attached with material with a large thermal conductivity.

FIG. 19 is a schematic diagram of a configuration of a cleaning blade 41 adhered with material with a high thermal conductivity. As shown in FIG. 21, a temperature rising relaxation of the contacting portion and the improvement on precision of an observation temperature are intended by increasing a thermal conductivity of the cleaning blade 41 in theory. Material with a high thermal conductivity is adhered on an outer peripheral face of the cleaning blade 41 as a heat distribution member (a heat spreader). Material used for the heat spreader includes a soft graphite sheet which is especially favorable in thermal conductivity in a plane direction.

As a result, a cleaning blade 41 surface temperature T2 in FIG. 18 can be caused to approach to a contacting portion temperature T1, and an advantage of suppressing temperature rising at the contacting portion can also be achieved. When a heat radiator such as a heat sink is provided on the heat spreader, a heat radiating effect can be obtained and visco-elasticity change is also suppressed.

Thus, the thermal conductivity of the cleaning blade can be increased in theory by arranging the heat spreader, observation information with a high precision and with a reduced deviation or delay of time response can be obtained even when a temperature observation is performed at a position far from the contacting portion of the cleaning blade 41. By providing the radiator on the heat spreader, a high heat radiating effect can be obtained, which allows suppression of the visco-elasticity change in the cleaning blade 41.

Figure 20:
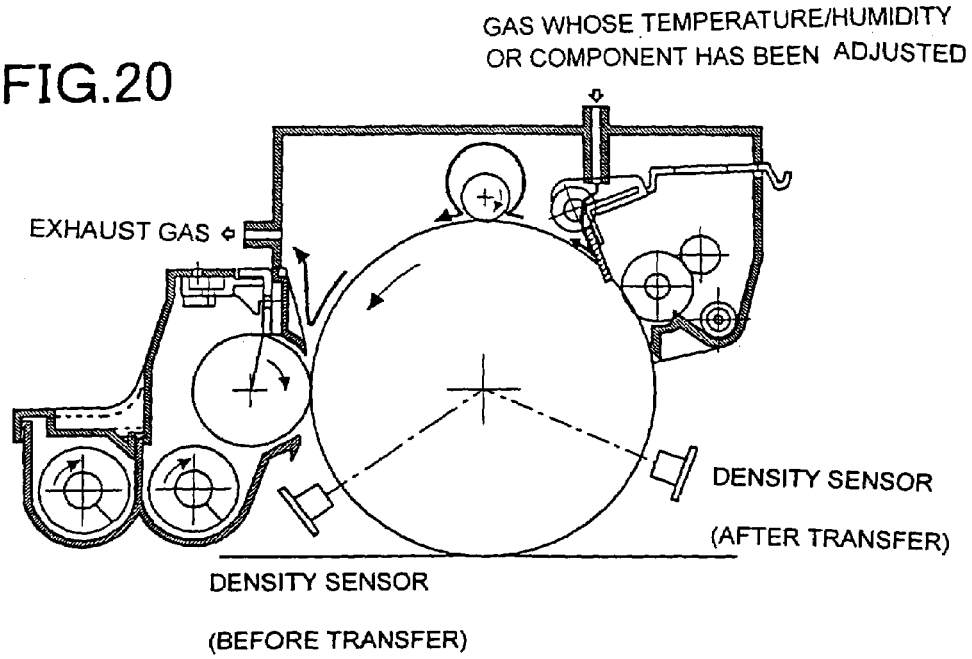
FIG. 20 is an example of a configuration where gas (which is not limited to air) whose temperature/humidity and components have been adjusted is supplied in order to positively maintain a condition of a cleaning blade as well as cooling.

FIG. 20 is a diagram of an example where gas (which may not be air) whose temperature/humidity and components have been adjusted in order to maintain a cleaning blade 41 in a favorable condition positively and which also serves as cooling medium is fed. Gas (a thick arrow in FIG. 20) whose temperature/humidity and components have been adjusted is fed toward the cleaning blade 41 while a space extending from the cleaning device 40 to the developing device 30 above the surface of the photoconductor 10 is handled as a substantially closed space. As a result, the visco-elasticity is stabilized by cooling of the cleaning blade 41 and occurrence of material due to discharging is suppressed on the charging portion of the photoconductor 10, so that a long life of the photoconductor 10 can be achieved.

The vibration observation of the cleaning blade 41 means observation of the condition of stick slip at the blade distal end, and the condition slightly varies according to an amount of toner interposed between the surface of the photoconductor 10 and the blade distal end. Since the index value is calculated while including information on the amount of inputted toner which influences the stick slip condition of the contacting portion of the cleaning blade 41, detection precision for abnormality of the cleaning blade 41 is improved.

Figure 23:
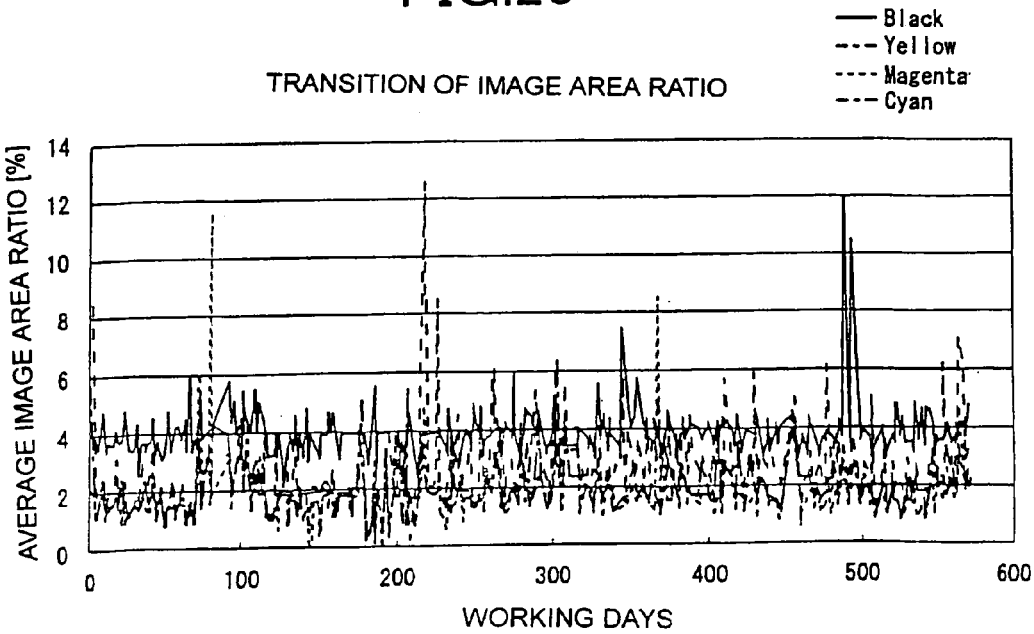
FIG. 23 is a graph of an example of transition of an average image area ratio obtained by using an image forming apparatus.

FIG. 23 is a graph of an example of transition of an average image area ratio due to use of the image forming apparatus 500. In an actual average image area ratio, as shown in FIG. 23, there may be a difference in an average image area ratio among colors, but taking fluctuation of the ratio for each day in consideration is effective to conduct vibration observation with a high precision.

By observing the amount of residual toner on the photoconductor 10 after transfer in a main scanning direction, input information on the toner amount can be obtained directly. Besides, in an image forming apparatus 500 provided with a writing device 12 of a digital system, such as a digital reproducing machine or a laser printer, since the number of pixels can easily be counted from input image data, the information can be utilized for precision improvement without providing a new detecting unit. As shown in FIG. 23, since toner concentrations before and after transfer can be observed by providing a post-transfer density sensor observing the toner amount after transfer so as to correspond to a pre-transfer density sensor which is provided for setting image forming conditions, a transfer efficiency can be obtained, and precision of the index value can be improved by correcting the previously described image area ratio data. Thus, detection improvement for abnormality of the cleaning blade 41 can be achieved with an inexpensive method.

When an image forming mode for observation of cleaning blade vibrations is provided in addition to a normal image forming mode, conditions during vibration observation can be arranged, so that observation data with reduced noises can be acquired and stable observation data can be obtained. At this time, when a transfer step is configured so as to allow contacting on/separating from the photoconductor 10, since transfer does not influence the input toner amount, the post-transfer density sensor is not required, and wasteful consumption of transfer paper can be avoided.

According to the present invention, multi-dimensional data of vibration frequencies are observed with substitution thereof with one measurement without reducing the information amount largely, a detector that can grasp vibration change corresponding to a frictional condition of the cleaning blade accurately to perform detection of abnormality such as filming or cleaning failure can be provided. Since as well as downsizing and weight saving a stable sensitivity over a wide range can be obtained, a detector that can eliminate necessity for performing optimization of a configuration for each machine can be provided. A detector that allows much reduction of system disturbance can be provided. Since vibrations generated from a distal end of a movable member such as a gear are suppressed from being transmitted to a blade supporting member, a detector that increases signal components from a distal end of a blade, which occupy vibration waveform, to improve a detection output of change of condition can be provided.

Since a preventive action can be performed by condition-setting a state before an image failure is developed with an index value to control operation of a filming removing unit, a period elapsing until the image failure is developed is extended. Therefore, a cleaning device, a process cartridge, and an image forming apparatus that allows extension of the life of an image carrier in theory can be provided.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A detector that detects abnormality regarding a condition of contact of a blade, wherein a blade made from elastomer is brought into contact with a rotating member, vibrations of the blade or a supporting member for the blade is observed, an index value based upon a normal condition is calculated by multi-dimensional data for each frequency obtained according to Fourier transform of the vibrations as signals, so that abnormality regarding a condition of contact of the blade such as presence of adhesion material or damage to the rotating member is detected.

2. The detector according to claim 1, wherein the vibrations are observed using a piezoelectric element disposed on the blade or the supporting member.

3. The detector according to claim 1, wherein the vibrations are observed by an electrostatic capacity of parallel flat plate electrodes disposed on the blade or the supporting member.

4. The detector according to claim 1, wherein the vibrations are observed by an induction electromotive power generated in a coil provided on a vibration plate disposed on the blade or the supporting member.

5. The detector according to claim 1, wherein the vibrations are observed by optically detecting a fine displacement of a specific portion on the blade or the supporting member.

6. A cleaning device which is disposed so as to be opposed to an image carrier which carries an electrostatic latent image and forms a toner image developed with developer, and which is provided with a cleaning blade which cleans at least toner on the image carrier and a supporting member which supports the blade, comprising:

a detector that observes vibrations of a cleaning blade coming into contact with an image carrier or a blade supporting member which supports the blade to calculate an index value based upon a normal condition using multi-dimensional data for each frequency obtained according to Fourier transform of the vibrations as signals, thereby detecting abnormality of a condition of contact of the cleaning blade with the image carrier such as presence of adhesion material or damage to the image carrier.

7. The cleaning device according to claim 6, wherein the vibrations are observed using a piezoelectric element disposed on the blade or the supporting member.

8. The cleaning device according to claim 6, wherein the vibrations are observed by an electrostatic capacity of parallel flat plate electrodes disposed on the blade or the supporting member.

9. The cleaning device according to claim 6, wherein the vibrations are observed by an induction electromotive power generated in a coil provided on a vibration plate disposed on the blade or the supporting member.

10. The cleaning device according to claim 6, wherein the vibrations are observed by optically detecting a fine displacement of a specific portion on the blade or the supporting member.

11. The cleaning device according to claim 6, wherein the supporting member is supported visco-elastically.

12. The cleaning device according to claim 6, wherein a swinging fulcrum of the blade supporting member is supported by a damper.

13. The cleaning device according to claim 6, wherein a pressurizing member of the blade supporting member is supported by a damper.

14. The cleaning device according to claim 6, wherein the blade supporting member is fixed to a casing, and a damper is adhered or held to a fixing face of the casing.

15. A process cartridge that supports an image carrier and at least one of a charging device, a developing device, and a cleaning device integrally, and is attachable to/detachable from an image forming apparatus main unit, comprising:

a detector that observes vibrations of a cleaning blade coming into contact with an image carrier or a supporting member which supports the blade to calculate an index value based upon a normal condition using multi-dimensional data for each frequency obtained according to Fourier transform of the vibrations as signals, thereby detecting abnormality of a condition of contact of the cleaning blade with the image carrier such as presence of adhesion material or damage to the image carrier.

16. A process cartridge that supports at least a cleaning device and an image carrier integrally and is attachable to/detachable from an image forming apparatus main unit, wherein the process cartridge disposes a cleaning device, which comprises a detector that observes vibrations of a cleaning blade coming into contact with an image carrier or of a supporting member which supports the blade to calculate an index value based upon a normal condition using multi-dimensional data for each frequency obtained according to Fourier transform of the vibrations as signals, thereby detecting abnormality of a condition of contact of the cleaning blade with the image carrier such as presence of adhesion material or damage to the image carrier.

17. An image forming apparatus including an image carrier on which an electrostatic latent image is formed, a charging device that brings a charging member in contact with a surface of the image carrier or causes the charging member to contact on the surface of the image carrier for charging the image carrier, a latent image forming device that forms a latent image on the image carrier, a developing device that cause toner to adhere to the latent image on the image carrier to develop the same, a transfer device that forms a transfer electric field between the image carrier and a surface moving member surface-moving while coming into contact with the image carrier to transfer a toner image formed on the image carrier to a recording member sandwiched between the image carrier and the surface moving member or to the surface moving member, and a cleaning device that cleans toner on the image carrier by a cleaning blade, wherein the image forming apparatus comprises: at least a cleaning blade which is disposed to be opposed to an image carrier which carries an electrostatic latent image and on which a toner image developed with developer is formed, and a blade supporting member for the cleaning blade; and a detector that observes vibrations of the cleaning blade coming into contact with the image carrier or the supporting member to calculate an index value based upon a normal condition using multi-dimensional data for each frequency obtained according to Fourier transform of the vibrations as signals, thereby detecting abnormality of a condition of contact of the cleaning blade with the image carrier such as presence of adhesion material or damage to the image carrier.

18. The image forming apparatus according to claim 17, further comprising a filming removing unit that removes adhesion material on the image carrier, wherein the detector monitors the index value based upon a normal condition, and operation of the filming removing unit is controlled in response to detection of increase of the index value.

19. The image forming apparatus according to claim 18, wherein the filming removing unit is a roller-shaped melamine foam which can contact on/separate from the image carrier.

20. The image forming apparatus according to claim 18, wherein the filming removing unit is operated based upon the number of revolutions of the cleaning brush or an amount of toner inputted to the cleaning unit.

21. The image forming apparatus according to claim 18, wherein, when the index value is not be decreased even by operation of the filming removing unit, it is determined that the image carrier has ended the life thereof, and a replacement request is displayed on a display device or is transmitted to a monitoring device through a communication unit.

22. The image forming apparatus according to claim 17, further comprising a unit that observes a temperature of the blade, wherein the index value is calculated by acquired temperature data in combination with the vibration data.

23. The image forming apparatus according to claim 22, further comprising a unit that observes any one of temperature and humidity in a space near the blade, wherein the index value is calculated by average data of a certain period in the past and a standard deviation of the any one of temperature and humidity in combination with the vibration data.

24. The image forming apparatus according to claim 22, further comprising a heat spreader with a high thermal conductivity arranged on a surface of the blade, wherein the index value is calculated by temperature data obtained by observing a surface temperature of the blade in combination with the vibration data.

25. The image forming apparatus according to claim 17, further comprising a unit that supplies gas whose any one of temperature and humidity or component has been adjusted into a space near the blade.

26. The image forming apparatus according to claim 17, further comprising a unit that observes an amount of inputted toner to the cleaning blade, wherein the index value is calculated by the amount of input toner in combination with the vibration data.

27. The image forming apparatus according to claim 26, further comprising a unit that calculates an image area ratio from image data inputted into the image forming apparatus, wherein the index value is calculated by the image area ratio in combination with the vibration data.

28. The image forming apparatus according to claim 27, further comprising a unit that detects an amount of toner on the image carrier before transfer and an amount of residual toner on the image carrier after transfer, wherein the image area ratio is corrected on the basis of a ratio (a transfer ratio) between the amount of toner on the image carrier before and after transfer.

29. The image forming apparatus according to claim 17, further comprising a unit that forms a fixed image pattern in operations during and just before the vibration observation, wherein the vibration data is acquired.

30. The image forming apparatus according to claim 29, further comprising a unit that forms a fixed image pattern in operations during vibration observation and just before the vibration observation, wherein a transfer operation is not performed during forming of the image pattern.

* * * * *